US010249944B1

(12) United States Patent
Ng et al.

(10) Patent No.: US 10,249,944 B1
(45) Date of Patent: Apr. 2, 2019

(54) SYSTEMS, APPARATUS, AND METHODS TO IMPROVE ANTENNA PERFORMANCE IN ELECTRONIC DEVICES

(71) Applicant: Antwave Intellectual Property Limited, Hong Kong (HK)

(72) Inventors: Kung Bo Ng, Hong Kong (HK); Chun Kai Leung, Hong Kong (HK); Ming Lu, Hong Kong (HK); Hang Wong, Hong Kong (HK); Chi Sun Yu, Hong Kong (HK)

(73) Assignee: Antwave Intellectual Property Limited, Hong Kong (HK)

( * ) Notice: Subject to any disclaimer, the term of this patent is extended or adjusted under 35 U.S.C. 154(b) by 0 days.

(21) Appl. No.: 15/831,374

(22) Filed: Dec. 4, 2017

Related U.S. Application Data

(60) Provisional application No. 62/563,064, filed on Sep. 25, 2017.

(51) Int. Cl.

| | |
|---|---|
| ***H01Q 1/24*** | (2006.01) |
| ***H01Q 1/38*** | (2006.01) |
| ***H01Q 9/04*** | (2006.01) |
| ***H01Q 1/44*** | (2006.01) |
| *H01Q 5/30* | (2015.01) |

(52) U.S. Cl.
CPC ..... *H01Q 1/38* (2013.01); *H01Q 1/243* (2013.01); *H01Q 1/44* (2013.01); *H01Q 9/0442* (2013.01); *H01Q 5/30* (2015.01)

(58) Field of Classification Search
CPC ..... H01Q 1/38; H01Q 1/44; H01Q 9/0407; H01Q 1/243; H01Q 5/30
See application file for complete search history.

(56) References Cited

U.S. PATENT DOCUMENTS 5,631,660 A * 5/1997 Higashiguchi ..... H01Q 1/38 343/700 MS
7,847,753 B2 * 12/2010 Ishibashi ..... H01Q 1/243 343/702

(Continued)

FOREIGN PATENT DOCUMENTS

CN 103905095 A 7/2014
CN 105742797 A 7/2016

OTHER PUBLICATIONS

X. H. Jin et al., Super-Wideband Printed Asymmetrical Dipole Antenna, Progress in Electromagnetics Research Letters, 2011, p. 117-123, vol. 27.

(Continued)

*Primary Examiner* — Dameon E Levi
*Assistant Examiner* — Ab Salam Alkassim, Jr.

(57) ABSTRACT

Disclosed are a system, apparatus, and method for improving performance of antennas in electronic devices. The disclosed system, apparatus, and method uses a transparent dielectric substrate as an antenna. The transparent dielectric substrate may receive energy from a wave launcher and printed circuit board. To work as an antenna, the whole structure may include at least one wave launcher located between the dielectric transparent substrate and a printed circuit board. Also, the structure may include a ground at the bottom of solid dielectric transparent substrate with a separation space. The space should not be less than wavelength 1/10 of fundamental resonant frequency.

19 Claims, 19 Drawing Sheets

(56) References Cited

U.S. PATENT DOCUMENTS 8,831,537 B2 * 9/2014 Fratti ..... H01Q 1/44 343/700 MS
8,998,099 B2 * 4/2015 Frey ..... H01Q 1/2225 235/449
9,164,607 B2 * 10/2015 Frey ..... G06F 3/044
9,325,072 B2 * 4/2016 Oh ..... H01Q 9/40
9,652,073 B2 * 5/2017 Lim ..... H01Q 1/36
9,917,349 B2 * 3/2018 McMilin ..... H01Q 1/243
10,141,633 B2 * 11/2018 Cheng ..... H01Q 9/42
2002/0036593 A1 * 3/2002 Ying ..... H01Q 1/243 343/702
2004/0183788 A1 * 9/2004 Kurashima ..... G06F 3/03547 345/173
2007/0040756 A1 * 2/2007 Song ..... H01Q 1/1271 343/713
2009/0051620 A1 * 2/2009 Ishibashi ..... H01Q 1/243 343/897
2009/0315792 A1 * 12/2009 Miyashita ..... H01Q 1/243 343/742
2011/0122036 A1 * 5/2011 Leung ..... H01Q 9/0485 343/785
2011/0260936 A1 * 10/2011 Leung ..... H01L 31/0525 343/720
2011/0273382 A1 * 11/2011 Yoo ..... G06F 3/041 345/173
2011/0298670 A1 * 12/2011 Jung ..... H01Q 1/243 343/702
2012/0034888 A1 * 2/2012 De Flaviis ..... G06F 1/1698 455/129
2012/0050126 A1 * 3/2012 Chung ..... H01Q 9/0414 343/834
2012/0062487 A1 * 3/2012 Lee ..... G06F 3/0412 345/173
2013/0010208 A1 * 1/2013 Chiang ..... F25D 29/00 348/739
2013/0059532 A1 * 3/2013 Mahanfar ..... H04B 5/0031 455/41.1
2014/0045424 A1 * 2/2014 Fratti ..... H01Q 1/44 455/41.1
2014/0071021 A1 * 3/2014 Liu ..... H01L 23/5227 343/893
2014/0104157 A1 * 4/2014 Burns ..... H01Q 1/243 345/156
2014/0106684 A1 * 4/2014 Burns ..... H01Q 1/243 455/78
2014/0300518 A1 * 10/2014 Ramachandran ..... H01Q 1/243 343/702
2015/0029064 A1 * 1/2015 Pan ..... H01Q 1/22 343/720
2015/0061942 A1 * 3/2015 Koyama ..... G09F 9/00 343/700 MS
2015/0061944 A1 * 3/2015 Boire ..... H01Q 5/335 343/702
2015/0244058 A1 * 8/2015 Lin ..... H01Q 1/2266 343/702
2016/0093939 A1 * 3/2016 Kim ..... H01Q 1/243 343/720
2016/0134008 A1 * 5/2016 Kim ..... H01Q 1/38 343/711
2016/0181689 A1 * 6/2016 Bishop ..... H01Q 1/364 343/700 MS
2016/0190678 A1 * 6/2016 Hong ..... H01Q 1/38 343/700 MS
2016/0328057 A1 * 11/2016 Chai ..... G06F 3/0412
2016/0344089 A1 * 11/2016 Baik ..... G04G 21/04
2017/0025760 A1 * 1/2017 Luk ..... H01Q 9/0457
2017/0040711 A1 * 2/2017 Rakib ..... H01Q 1/246
2017/0093023 A1 * 3/2017 Cai ..... G06F 3/041
2017/0125897 A1 * 5/2017 Rubin ..... H01Q 21/28
2017/0139520 A1 * 5/2017 Yeh ..... G06F 3/0416
2017/0179567 A1 * 6/2017 Zou ..... H01Q 1/22
2017/0344766 A1 * 11/2017 Yashiro ..... G06K 7/10
2017/0352959 A1 * 12/2017 Sugita ..... H01Q 1/24
2017/0373397 A1 * 12/2017 Yashiro ..... H01Q 1/38
2018/0034130 A1 * 2/2018 Jang ..... H01L 27/3225

OTHER PUBLICATIONS

Chung-Hsiu Chiu et al., Compact Dual-Band Dipole Antenna with Asymmetric Arms for WLAN Applications, Hindawi Publishing Corporation International Journal of Antennas and Propagation, Mar. 17, 2014, p. 1-4, vol. 2014, Article ID 195749.

Mark E. Vickberg et al., Design Considerations for Indoor Wireless Transmission between a Body-Worn Physiological Monitoring Device and a Gateway in a Home Environment, American Journal of Biomedical Engineering, Jun. 2016, p. 95-114, 6(4).

R. Poonkuzhali et al., Miniaturized Wearable Fractal Antenna for Military Applications at VHF Band, Progress in Electromagnetics Research C, 2016, p. 179-190, vol. 62.

International Search Report of PCT Patent Application No. PCT/CN2017/114515 dated Apr. 28, 2018.

* cited by examiner

100

Patch mode propagate underneath the sapphire at 2.6 GHz

SYSTEMS, APPARATUS, AND METHODS TO IMPROVE ANTENNA PERFORMANCE IN ELECTRONIC DEVICES

CROSS-REFERENCE TO RELATED APPLICATIONS AND PRIORITY

The present application claims priority from U.S. Provisional Patent Application No. 62/563,064 dated Sep. 25, 2017, the entirety of which is incorporated herein by a reference.

TECHNICAL FIELD

The disclosed subject matter relates to a system, apparatus, and method to improve antenna performance in electronic devices, more particularly the disclosed subject matter relates to a system, apparatus, and method to use a new non-conducting material in antenna for improving performance of the antenna in the electronic devices.

BACKGROUND

Generally, electronic products comprise a plurality of antennas for various purposes. However, as technologies like IOT, RFID, NFC, wearable devices, etc. are becoming popular in the market, size of the electronic products is also becoming smaller and smaller. Thereby, traditional antennas available in the market are no longer suitable to be used in the ever decreasing size of the electronic products, as room for multiple antennas in smaller electronic products is not sufficient enough considering most of the traditional antennas need a large ground plane. Also, as the antennas are surrounded by various other metals and conducting materials, performance of the antennas get significantly affected, especially in small sized electronic products due to compact packaging of materials.

For example, as per current market trend, most of the electronic products comprise different types of antennas such as Bluetooth, GPS, WiFi, 4G, 5G, NFC, RFID, millimeter wave application in 60 GHz or above, etc. As there are so many antennas needed in electronic products, they all occupy significant space in the electronic products. Thereby, the space occupied by the various antennas is questionable, especially considering the ever decreasing size of the electronic devices. Currently, the only solution for decreasing size of the electronic products is to tightly pack all the electronic components/modules together. However, tight packing of all components of the electronic products imposes significant affect in antenna performance such as gain, efficiency, radiation pattern, etc.

Therefore, there exists a need for developing a solution for reducing size of electronic devices without affecting the performance of antennas in the electronic devices.

SUMMARY

This summary is provided to introduce concepts related to system and method for prioritizing and scheduling notifications to a user on user's device and the concepts are further described in the detailed description. This summary is not intended to identify essential features of the claimed subject matter nor is it intended for use in determining or limiting the scope of the claimed subject matter.

In an implementation, embodiments of the present disclosure discloses a dielectric transparent antenna comprising at least one layer of solid dielectric transparent substrate, at least electric circuit with a ground connection, and at least one wave launcher located between the dielectric transparent substrate and the electric circuit with a separation space (h). Herein, the space (h) is equal or greater than 1/10 wavelength of resonant frequency.

Further, in an embodiment of the present disclosure, the wave launcher couples energy to the dielectric transparent substrate. In another embodiment of the present disclosure, the energy reinforces inside the dielectric transparent substrate to create resonant frequency. In another embodiment of the present disclosure, the wave launcher enables the dielectric transparent substrate to radiate electromagnetic wave with the resonant frequency. Herein, the dielectric transparent substrate also receives electromagnetic waves. In another embodiment of the present disclosure, the resonant frequency is of linear or circular polarization. In another embodiment of the present disclosure, the dielectric constant of the dielectric transparent substrate is larger than 2.

In another embodiment of the present disclosure, the wave launcher is placed at surface of the dielectric transparent substrate, wherein the wave launcher produces a phase difference i.e. $0° \leq \Theta \leq 90°$ for the resonant frequency. In another embodiment of the present disclosure, the dielectric transparent antenna is used in an electronic device with a display panel, wherein the wave launcher is placed under the display panel without affecting transparency of the dielectric transparent substrate.

Further, dimensions of the dielectric transparent substrate are designed according to shape and size of an electronic device. In another embodiment of the present disclosure, the dielectric transparent substrate comprises a plurality of vertical layers, horizontal layers, or both and gap between the dielectric transparent substrate layers is filled with at least one of air, liquid, plasma, and solid. In another embodiment of the present disclosure, dimension of the dielectric transparent substrate, position of wave launcher, and space (h) affects the resonant frequency.

In another embodiment of the present disclosure, length of the wave launcher is dependent upon wavelength of the resonant frequency. In another embodiment of the present disclosure, the dielectric transparent substrate is one of a transparent plastic, glass, sapphire (Al2O3), and acrylic. In another embodiment of the present disclosure, the dielectric transparent substrate comprises a semi-transparent material. In another embodiment of the present disclosure, the dielectric transparent substrate is coated/injected with another material comprising at least one of a paint, color, film.

In another embodiment of the present disclosure, the dielectric transparent substrate is installed at surface of an electronic device. In another embodiment of the present disclosure, the wave launcher is connected with a cable to a circuit board. In another embodiment of the present disclosure, the wave launcher is a feeding device where radio frequency signal energy travels from radio frequency circuit to the surface of the dielectric transparent substrate. In another embodiment of the present disclosure, the wave launcher is a printed circuit board. In another embodiment of the present disclosure, the dielectric transparent substrate layer is of 2 mm.

Other and further aspects and features of the disclosure will be evident from reading the following detailed description of the embodiments, which are intended to illustrate, not limit, the present disclosure

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DESCRIPTION

Figure 1A:
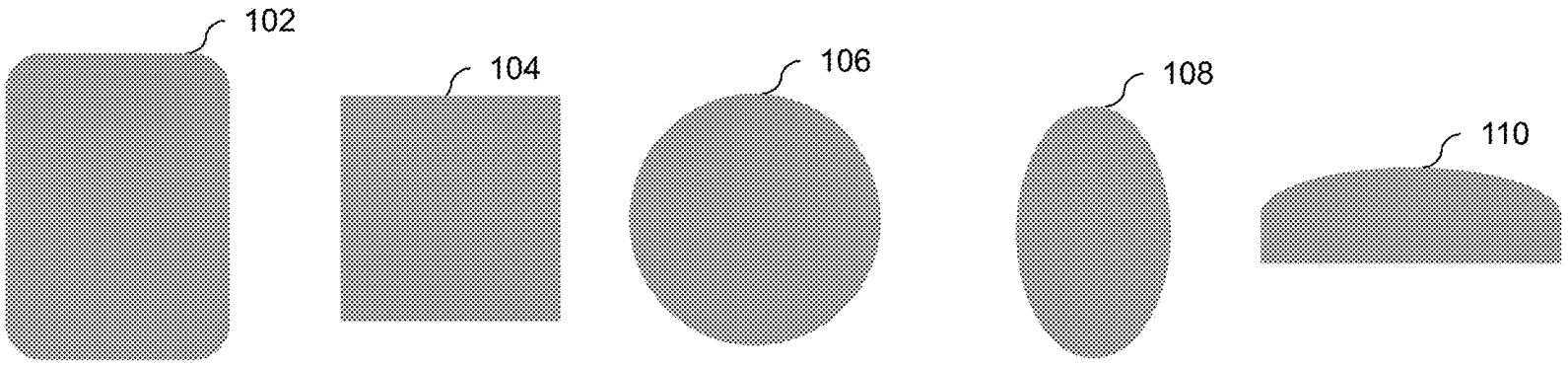
FIG. 1A illustrates various shapes in which a dielectric transparent substrate may be used within an electronic device as an antenna, in accordance with aspects of the embodiments.

A few inventive aspects of the disclosed embodiments are explained in detail below with reference to the various figures. Embodiments are described to illustrate the disclosed subject matter, not to limit its scope, which is defined by the claims. Those of ordinary skill in the art will recognize a number of equivalent variations of the various features provided in the description that follows.

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

The present invention provides a solution for using the transparent cover e.g. glass, sapphire, etc. of the electronic device to provide an antenna function in order to improve the traditional antenna performance. In traditional method, antenna is built inside the electronic device and so the antenna performance is affected by the size of electronic device, component and battery inside the device and all the metal parts of the device. The solution provided is based on a fact that if most of antennas are moved away from body of an electronic device and further if all the antennas of the electronic device are relocated on device's surface area then the required performance can be achieved even on small scale electronic devices. One of the reasons relates to the fact that antenna performance will not be affected by nearby electronic components. Another reason is based on a fact that radiation of antenna will improve as radiation will not be blocked by metals. Moreover, the space earlier occupied by the antennas will be available for other applications or devices (e.g., larger battery, headphone jack, more speakers, memory, etc.).

Therefore, embodiments of the present disclosure use a dielectric transparent substrate as an antenna by replacing original transparent substrate such as glass or sapphire of devices. The dielectric transparent substrate comprises a fully transparent material e.g. transparent plastic, glass, Sapphire ($Al_2O_3$), Acrylic, etc. not to exclude other semi-transparent materials. Furthermore, the dielectric transparent substrate can be coated with or injected with any different kind of coating materials such as paints, liquid, color, films, protective materials, etc.

Possible applications of the dielectric transparent substrate may comprise all smart devices and wearable devices with LCD display. For example, watch, mobile phone, tablet, computer, TV, advertisement display, glasses, etc. Other possible applications of the dielectric transparent substrate may comprise windows, door, glass wall, decoration, etc. The dielectric transparent substrate may also be used as indoor or outdoor antenna. For example, RFID, base station, WiFi, GPS, etc.

FIG. 1A illustrates various shapes in which the dielectric transparent substrate 100 may be used within an electronic device (not shown) as an antenna. For example, as illustrated, the dielectric transparent substrate 100 may be in a rounded rectangle shape 102. The dielectric transparent substrate 100 may also be in square shape 104. The dielectric transparent substrate 100 may also be in circle shape 106. The dielectric transparent substrate 100 may also be in oval shape 108. The dielectric transparent substrate 100 may also be in curved shape 110.

Figure 1D:
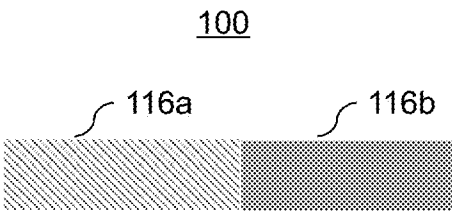
FIG. 1D illustrates a dielectric transparent substrate formed with multiple layers stacked horizontally, in accordance with aspects of the embodiments.
Figure 1C:
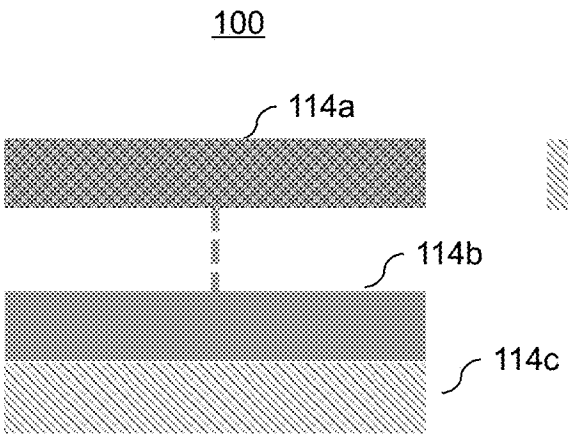
FIG. 1C illustrates a dielectric transparent substrate formed with multiple layers stacked vertically, in accordance with aspects of the embodiments.
Figure 1B:
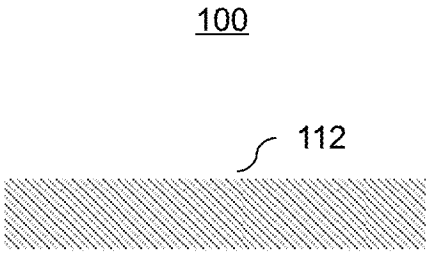
FIG. 1B illustrates a dielectric transparent substrate formed with a single layer, in accordance with aspects of the embodiments.

FIG. 1B illustrates the dielectric transparent substrate 100 formed with a single layer 112 and can be used in the electronic devices as antenna. FIG. 1C illustrates the dielectric transparent substrate 100 formed with multiple layers (114*a*, 114*b*, 114*c*) stacked vertically. FIG. 1D illustrates the dielectric transparent substrate 100 formed with multiple layers (116*a*, 116*b*) stacked horizontally. The multiple layers may be stacked using any material in between (e.g., air, glue, or other materials).

Figure 2B:
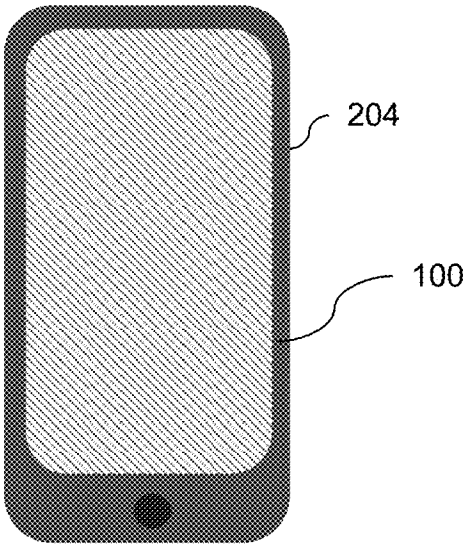
FIG. 2B illustrates another electronic device such as a phone/tablet installed with a dielectric transparent substrate, in accordance with aspects of the embodiments.
Figure 2A:
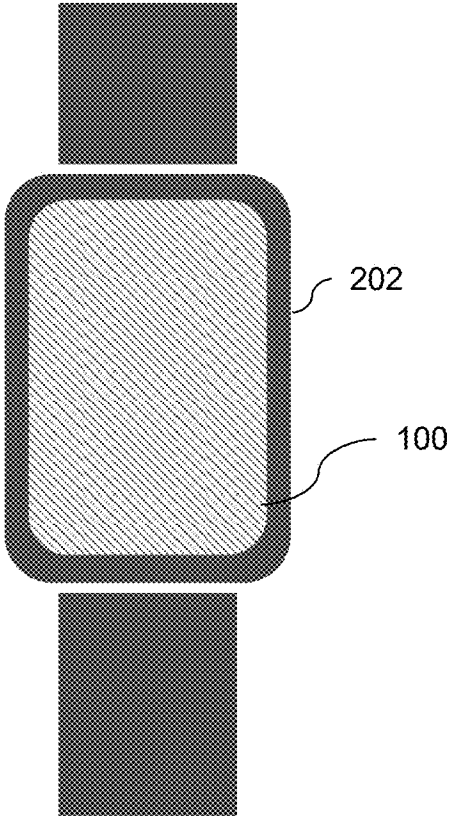
FIG. 2A illustrates an electronic device such as a wrist watch installed with a dielectric transparent substrate, in accordance with aspects of the embodiments.

FIG. 2A illustrates an electronic device such as a wrist watch 202 installed with the dielectric transparent substrate 100. The dielectric transparent substrate 100 here works as an antenna for the wrist watch 202. Also, as shown the dielectric transparent substrate 100 is installed on the surface of the wrist watch 202 and not inside the watch as per traditional methods. Similarly, FIG. 2B illustrates another electronic device such as a phone/tablet 204 installed with the dielectric transparent substrate 100. The dielectric transparent substrate 100 here works as an antenna for the phone/tablet 204. Also, as shown the dielectric transparent substrate 100 is installed on the surface of the phone/tablet 204 and not inside the phone/tablet 204, as per traditional methods. This helps in freeing space inside the electronic devices and that space may be used for other feature enhancement purposes or for size reduction purposes.

Figure 3:
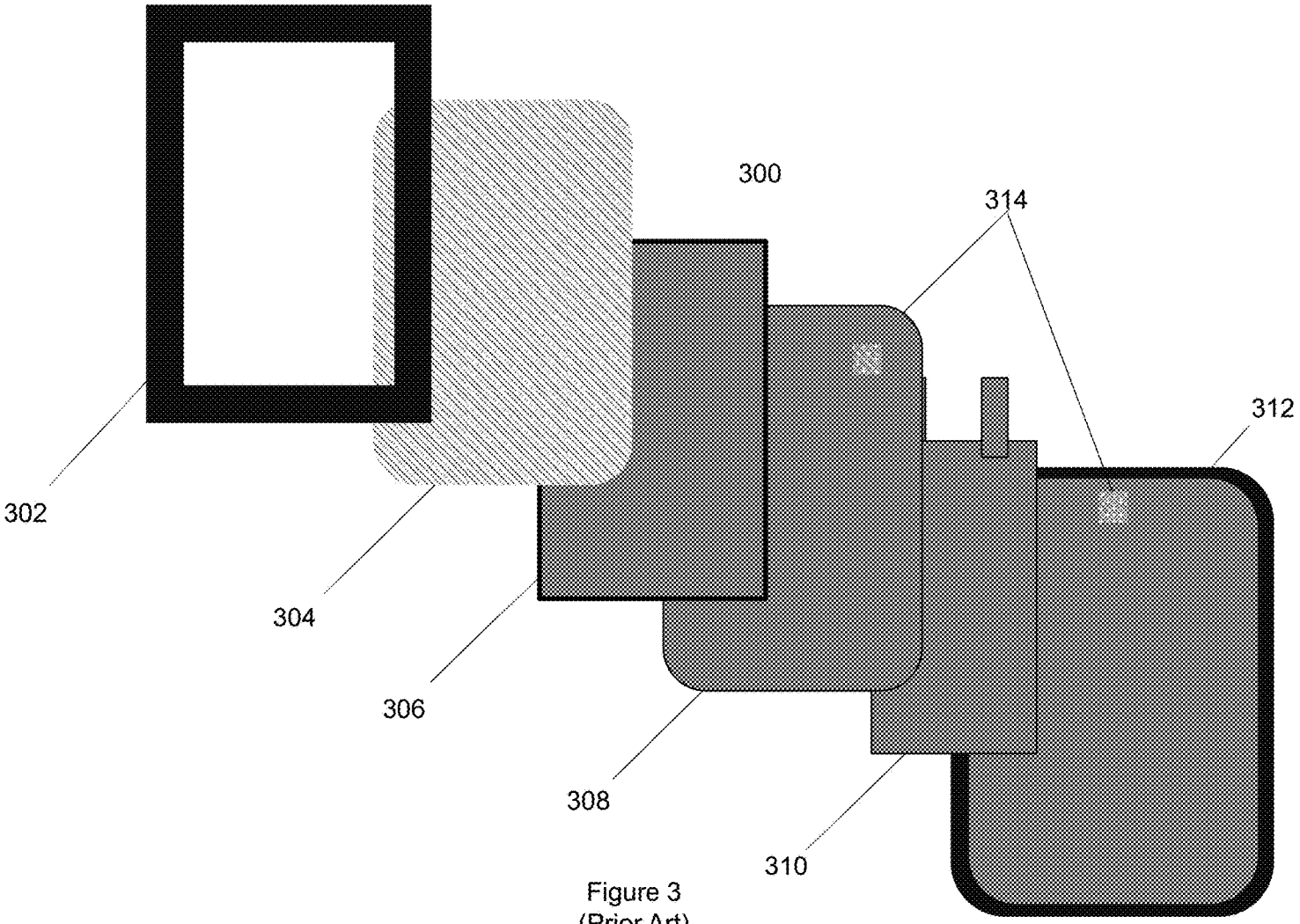
Figure 3 (Prior Art)
FIG. 3 illustrates typical architecture of an electronic device.

FIG. 3 illustrates typical architecture of an electronic device, such as a tablet/phone 300. As shown, the tablet/phone 300 comprises of a first layer of top frame 302. The tablet/phone 300 further comprises a second layer of transparent cover 304. The tablet/phone 300 further comprises a third layer of LCD display module 306. The tablet/phone 300 further comprises a fourth layer of PCB with electronic circuitry (with GND) 308. The tablet/phone 300 further comprises a fifth layer of battery 310. The tablet/phone 300 further comprises a sixth layer of bottom case cover 312. Further, as illustrated, the tablet/phone 300 also comprises chip/printed antenna/metal antenna 314. Clearly, the antenna is surrounded with many layers and therefore it may experience interference. A better solution of antenna designing is discussed further in conjunction with the FIG. 4 of the present invention.

Figure 4:
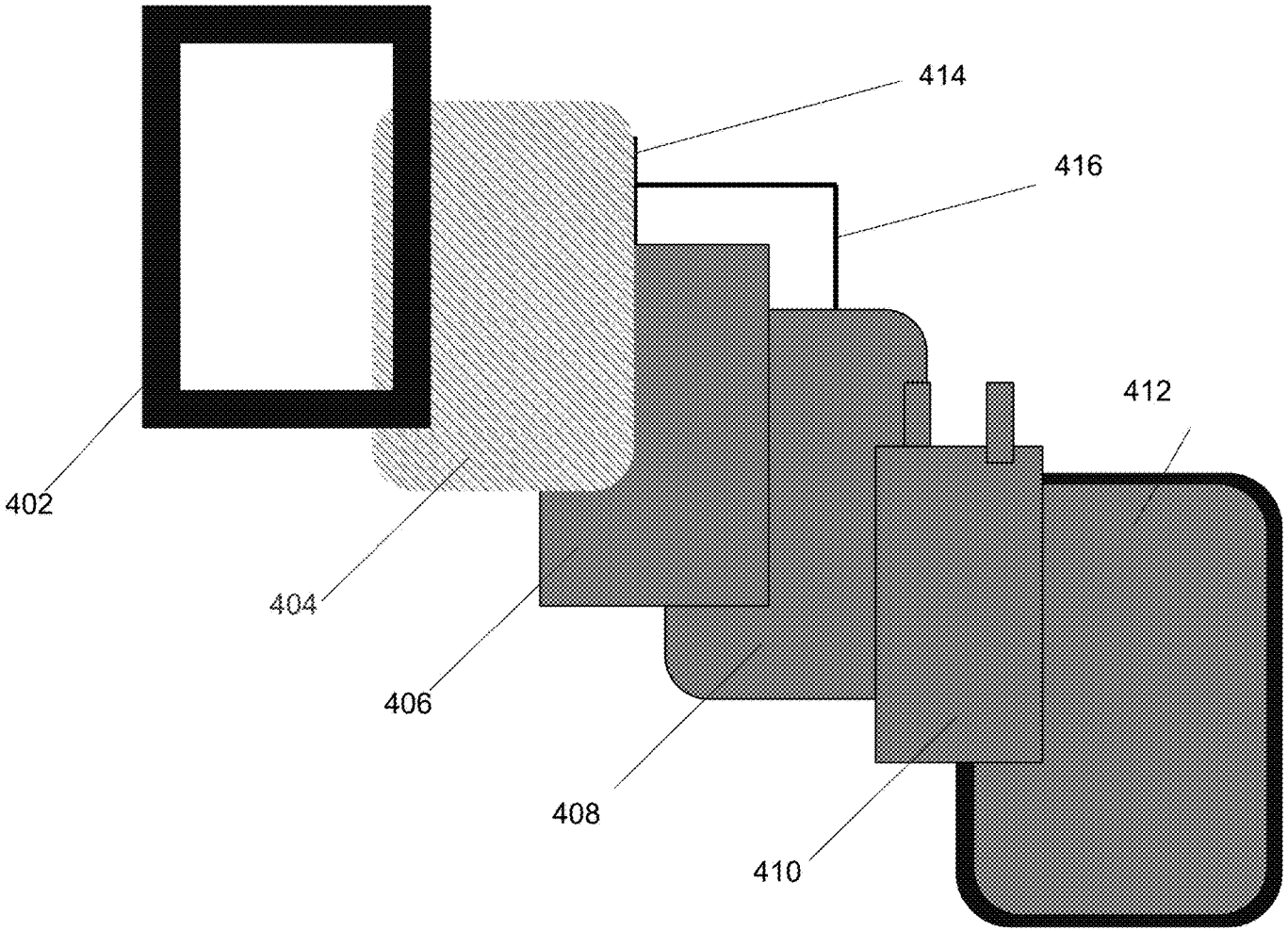
FIG. 4 illustrates architecture of an electronic device, in accordance with an aspect of the embodiments.

FIG. 4 illustrates architecture of an electronic device, such as a tablet/phone 400 that is installed with the dielectric transparent substrate 100 serving as an antenna. The architecture of the tablet/phone 400 is similar to the architecture of the tablet/phone 300 with an addition of the dielectric transparent substrate (such as the substrate 100) in the tablet/phone 400.

As shown, the tablet/phone 400 comprises of a first layer of top frame 402. The tablet/phone 400 further comprises a second layer of transparent cover 404 which also serves as an antenna as it is made up of the dielectric transparent substrate 100. The tablet/phone 400 further comprises a third layer of LCD display module 406. The tablet/phone 400 further comprises a fourth layer of PCB with electronic circuitry (with GND) 408. The tablet/phone 400 further comprises a fifth layer of battery 410. The tablet/phone 400 further comprises a sixth layer of bottom case cover 412.

Further, as illustrated, the tablet/phone 400 also comprises a wave launcher 414 that is connected with the transparent cover 404 made up of the dielectric transparent substrate 100. The wave launcher is further connected with the circuitry 408 via a connector 416 (such as a wire or cable). The wave launcher 414 enables the dielectric transparent substrate 100 to function as an antenna. Therefore, a traditional antenna is not required to be installed in the tablet/phone 400. Further, as the dielectric transparent substrate antenna is installed on the top layers, there is minimum to no interference in radiations, which ensures antenna performance. The wave launcher 414 is discussed further in conjunction with FIGS. 5-18 of the present invention.

Figure 5:
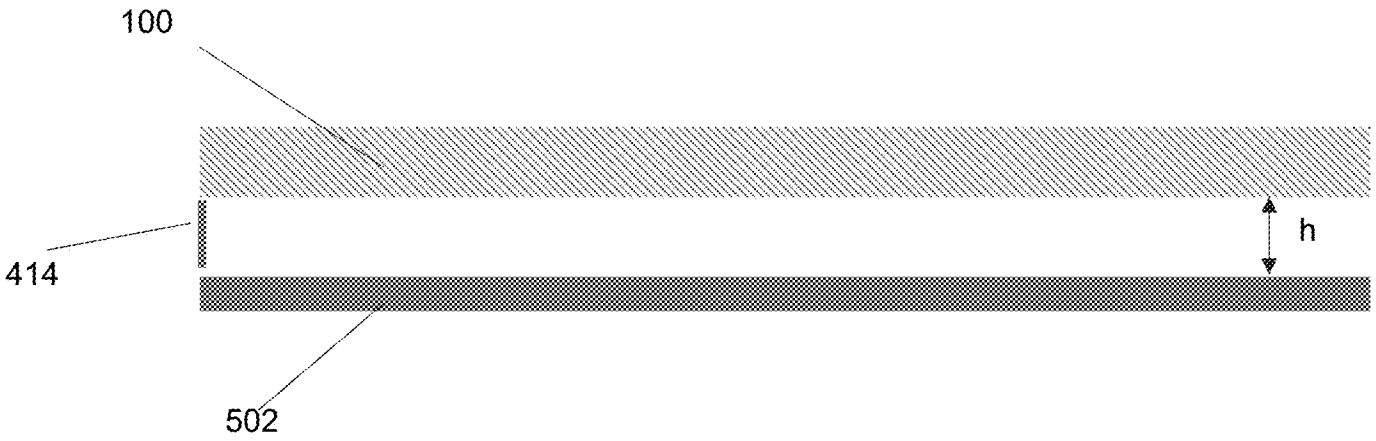
FIG. 5 illustrates architecture of a dielectric transparent substrate, wave launcher, and electronic circuit, in accordance with an aspect of the embodiments.

FIG. 5 illustrates architecture of the dielectric transparent substrate 100 and the wave launcher 414 with electronic circuit/GND 502. As shown, the wave launcher 414 locates between the dielectric transparent substrate 100 and the GND 502. The wave launcher 414 couples energy to the dielectric transparent substrate 100. Distance between the dielectric transparent substrate 100 and the GND 502 is illustrated with symbol 'h' representing height. Further, the distance between the dielectric transparent substrate 100 and the GND 502 may be filled with air. The height (h) is not less than 1/10 wavelength of resonant frequencies.

It is to be noted that dimension of the dielectric transparent substrate 100, position of the wave launcher 414 and the height (h) affects the resonance frequencies. The energy coupled to the dielectric transparent substrate 100 may reinforce between the dielectric transparent substrate 100 and the GND 502 to provide resonance frequencies (f1, f2 . . . ). Electromagnetic wave may radiate out or received to the dielectric transparent substrate 100 with the resonance frequencies.

Figure 6:
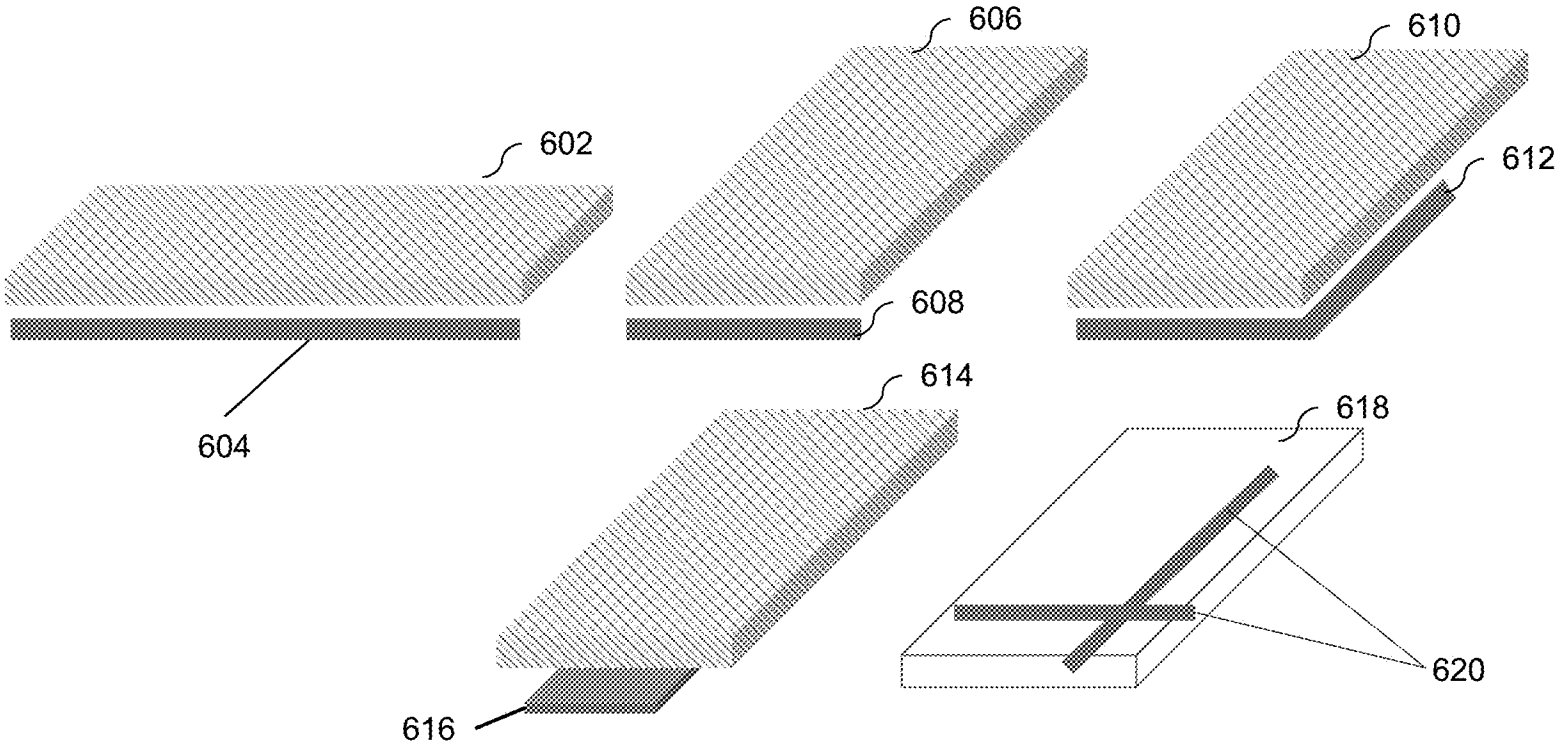
FIG. 6 illustrates various architectural possibilities of combining a wave launcher with a dielectric transparent substrate, in accordance with an aspect of the embodiments.

FIG. 6 illustrates various architectural possibilities of combining a wave launcher with a dielectric transparent substrate. As shown, the dielectric transparent substrate 602 has a wave launcher 604 of its longest side size. Another dielectric transparent substrate 606 has a wave launcher 608 of its shortest side size. Another dielectric transparent substrate 610 has more than one wave launchers 612 on two of its sides. Another dielectric transparent substrate 614 has a wave launcher 616 irrespective of the size of the dielectric substrate. Another dielectric transparent substrate 618 has more than one wave launchers 620 positioned in irregular manner.

For example, as shown the wave launcher may be placed at any surface of the dielectric transparent substrate. More than one wave launchers can also be placed at any surface of the dielectric transparent substrate. The wave launcher(s) may couple more than one resonant frequencies energy to the dielectric transparent substrate. The wave launcher(s) may provide $0° \leq \Theta \leq 90°$ phase different for the resonant frequencies. These frequencies may be from linear polarization (LP) to circular polarization (CP).

Figure 7:
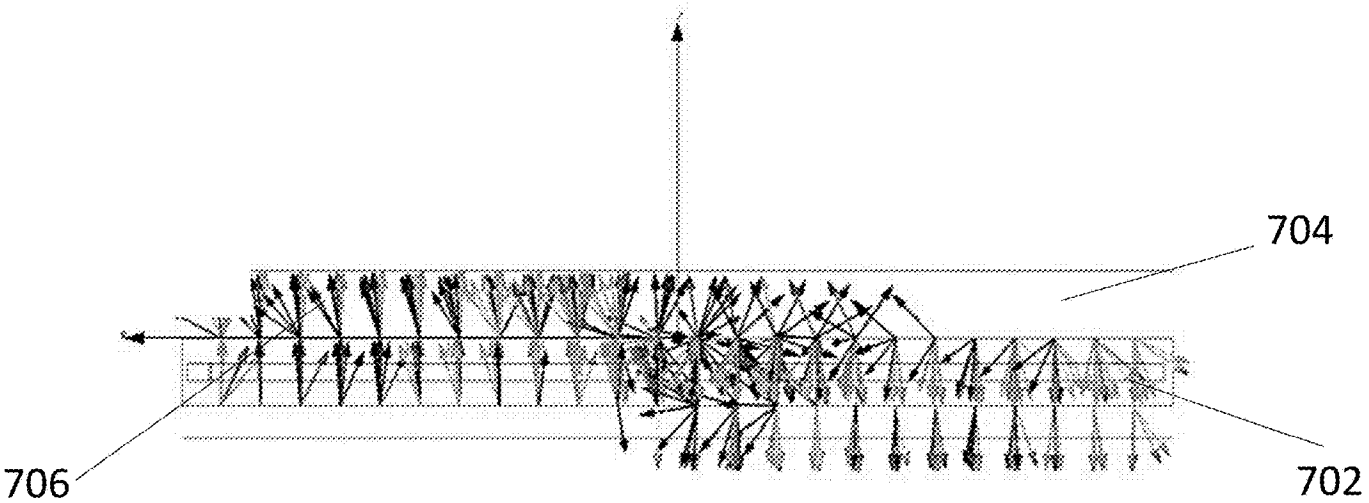
FIG. 7 illustrates a mode excitation chart of resonance frequency with half wavelength, in accordance with an aspect of the embodiments.
Figure 7:
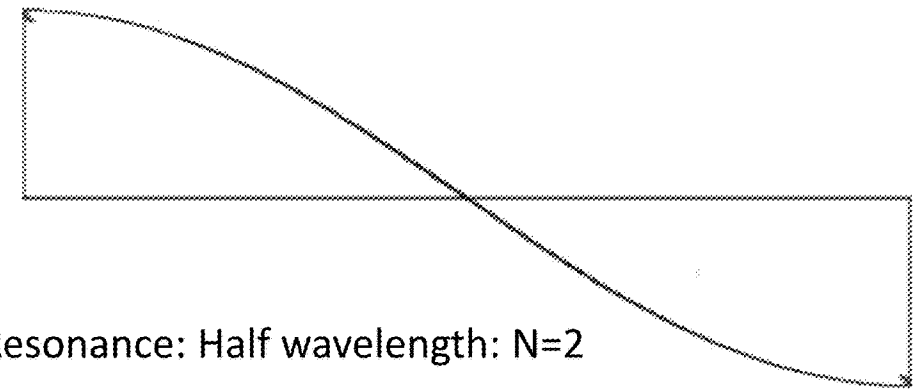

FIG. 7 illustrates a mode excitation chart of resonance frequency with half wavelength. As shown, wave launcher 702 is placed between dielectric transparent substrate 704 and ground (GND). The resultant resonant electric field 706 is also illustrated in fundamental mode of the given structure. The electric field resonant in fundamental mode of the given structure and to produce a resonances $N*\lambda_0/4$ (N=1, 2, 3 . . . ) as $TM_{N0}$ mode-like resonance. Herein, Resonance:

Half wavelength: N=2. More details are discussed in conjunction with FIG. 8 of the present invention.

Figure 8:
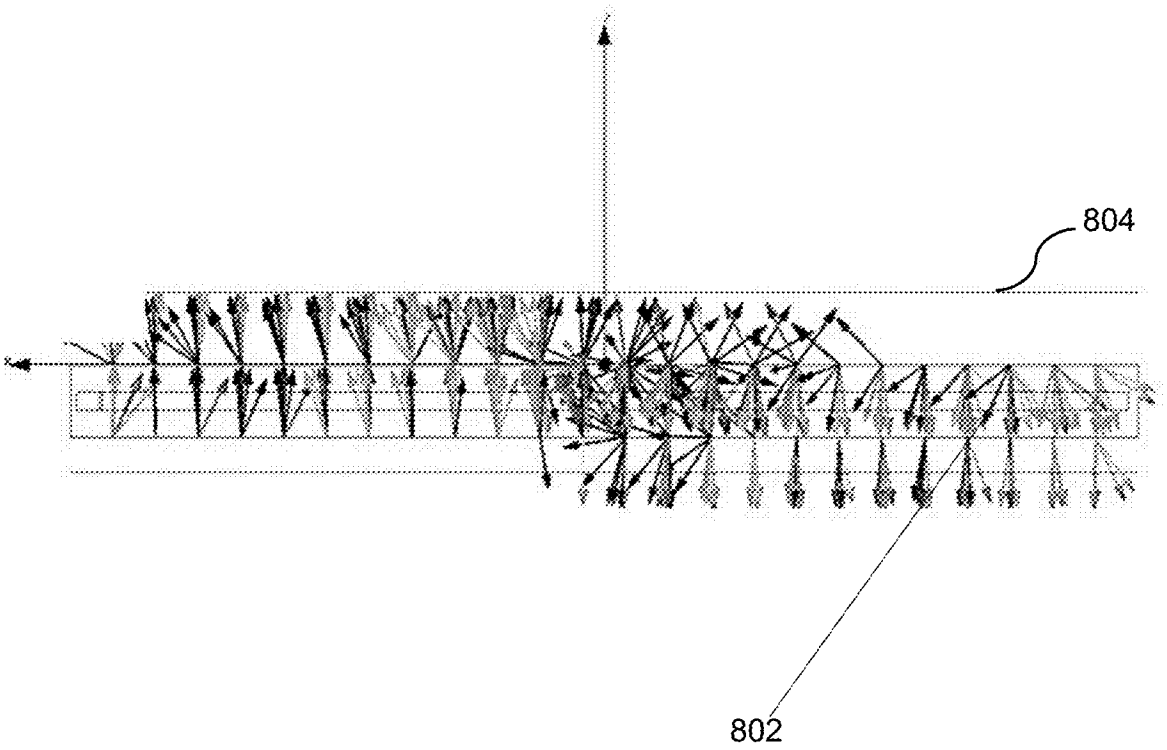
FIG. 8 illustrates a mode excitation chart of resonance frequency with full wavelength, in accordance with an aspect of the embodiments.

FIG. 8 illustrates a mode excitation chart of resonance frequency with full wavelength. As shown, a wave launcher 802 is placed between the dielectric transparent substrate 804 and GND. The length of wave launcher 802 is about a wavelength of the expected resonance frequency. It provides a $TM_{N0}$ mode like resonance, where N=1, 2, 3 . . . .

Figure 9:
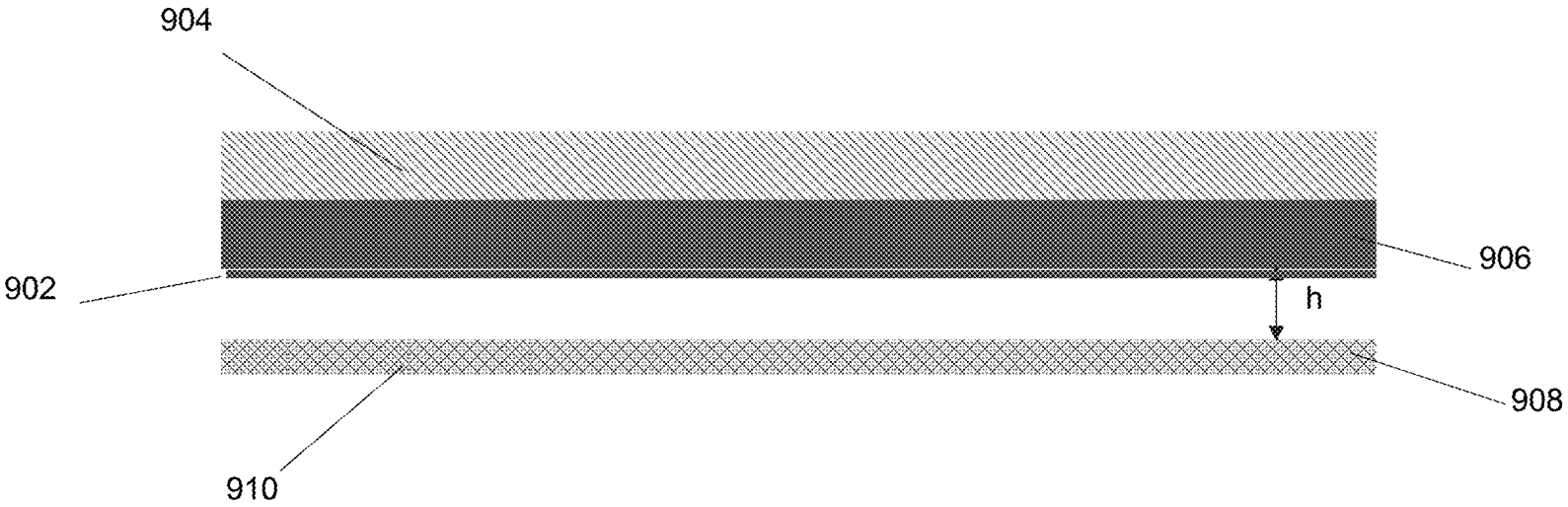
FIG. 9 illustrates architecture of an electronic device comprising a wave launcher, dielectric transparent substrate, LCD display, and a printed circuit board, in accordance with an aspect of the embodiments.

FIG. 9 illustrates architecture of an electronic device comprising a wave launcher 902, dielectric transparent substrate 904, LCD display 906, and a printed circuit board 908. The printed circuit broad also has ground (GND) 910 facility. The wave launcher can be placed directly under the LCD display 906 so that it will not affect the transparency of the dielectric transparent substrate by blocking the content shown on the LCD display 906.

Figure 10:
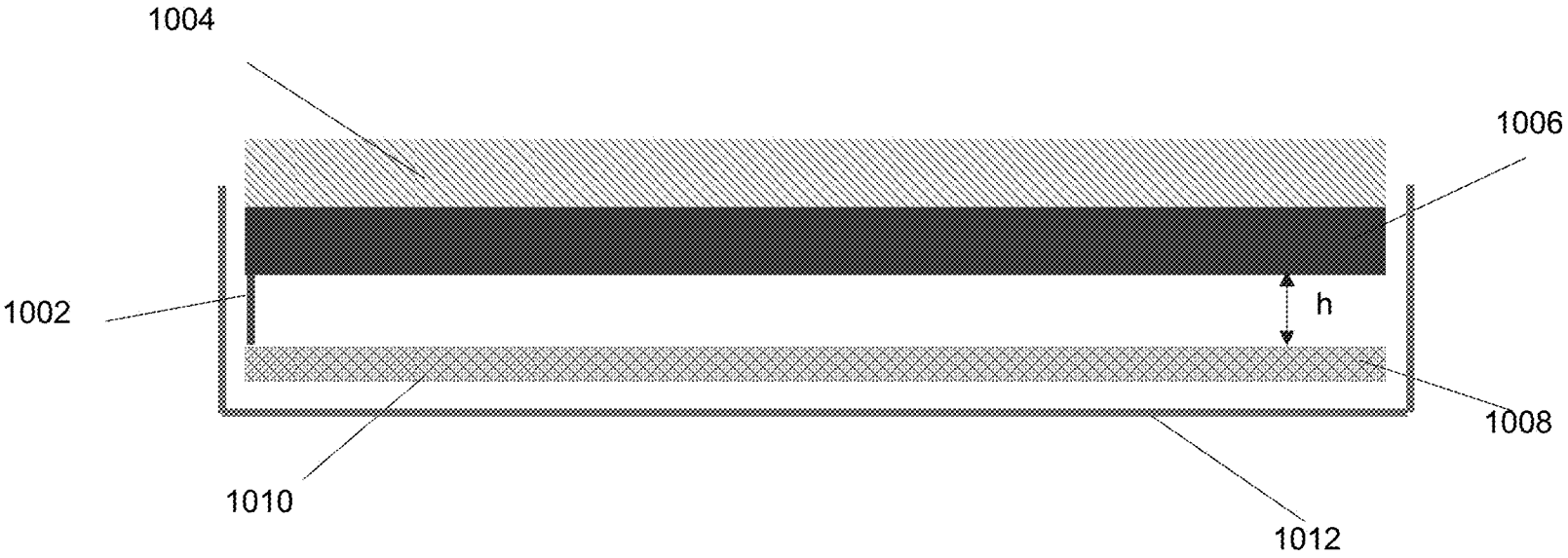
FIG. 10 illustrates architecture of an electronic device comprising a wave launcher, dielectric transparent substrate, LCD display, a printed circuit board, and a metal body case, in accordance with an aspect of the embodiments.

FIG. 10 illustrates architecture of an electronic device comprising a wave launcher 1002, dielectric transparent substrate 1004, LCD display 1006, a printed circuit board 1008, and a metal body case 1012. The printed circuit broad also has ground (GND) 1010 facility. The wave launcher can be placed directly under the LCD display 1006 on one side so that it will not affect the transparency of the dielectric transparent substrate by blocking the content shown on the LCD display 1006. Also, this architecture ensures minimum to no interference with the metal body case 1012 which may further act as ground (GND).

Figure 11:
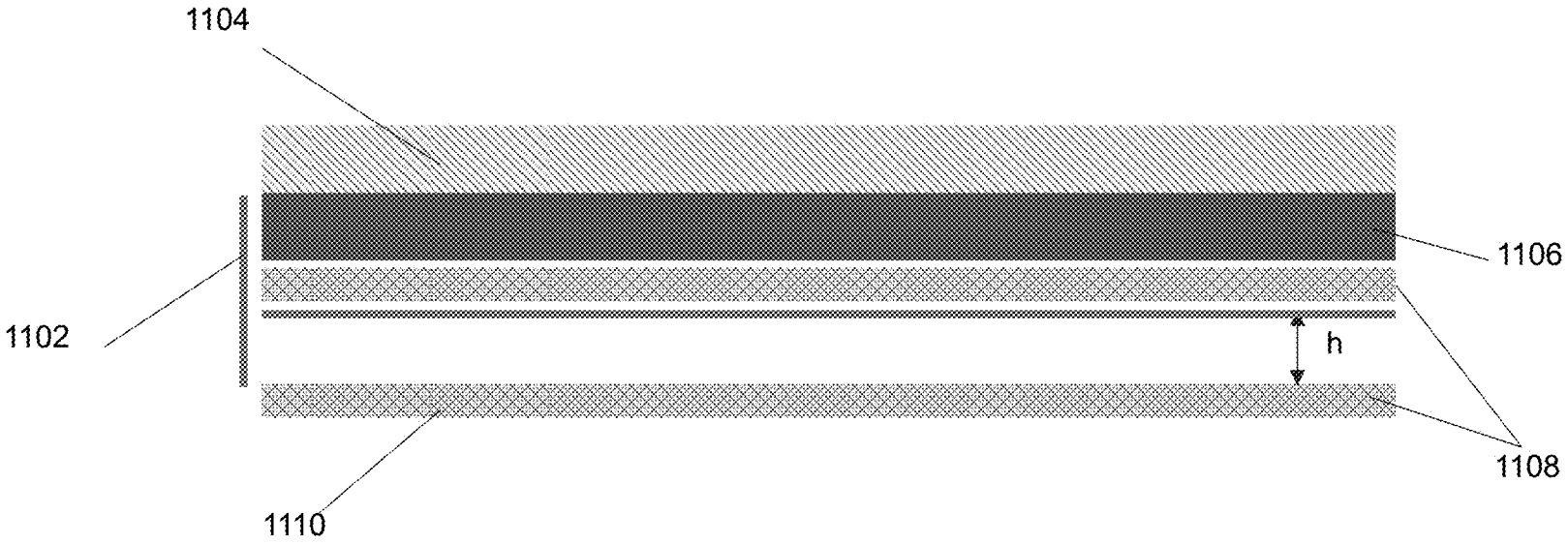
FIG. 11 illustrates architecture of an electronic device comprising a wave launcher, dielectric transparent substrate, LCD display, and two printed circuit boards, in accordance with an aspect of the embodiments.

FIG. 11 illustrates architecture of an electronic device comprising a wave launcher 1102, dielectric transparent substrate 1104, LCD display 1106, and two printed circuit boards 1108. The printed circuit broad also has ground (GND) 1010 facility. The wave launcher can be placed directly under the LCD display 1006 on one side so that it will not affect the transparency of the dielectric transparent substrate by blocking the content shown on the LCD display 1106.

Figure 12:
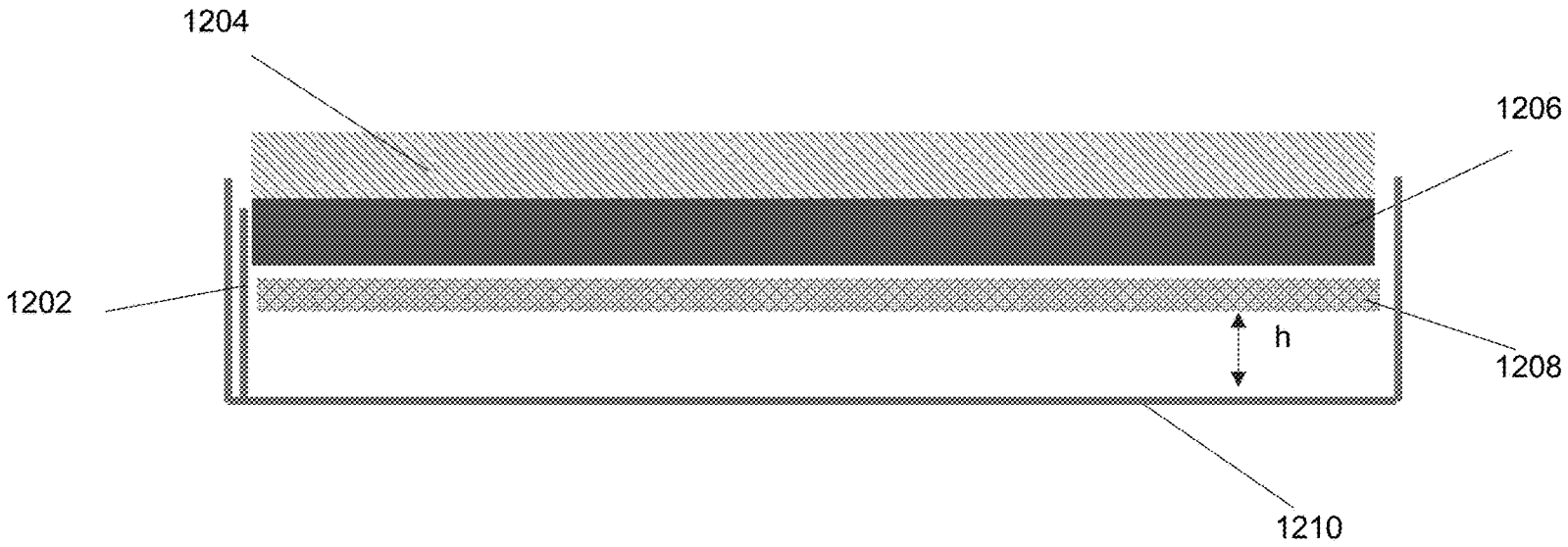
FIG. 12 illustrates architecture of a wave launcher, dielectric transparent substrate, LCD display, a printed circuit board, and a metal body case, in accordance with an aspect of the embodiments.

FIG. 12 illustrates architecture of a wave launcher 1202, dielectric transparent substrate 1204, LCD display 1206, a printed circuit board 1208, and metal body case 1210. The wave launcher 1202 can be placed directly under the LCD display 1206 on one side so that it will not affect the transparency of the dielectric transparent substrate by blocking the content shown on the LCD display 1206. Also, this architecture ensures minimum to no interference with the metal body case 1210 which may further act as ground (GND).

Figure 13:
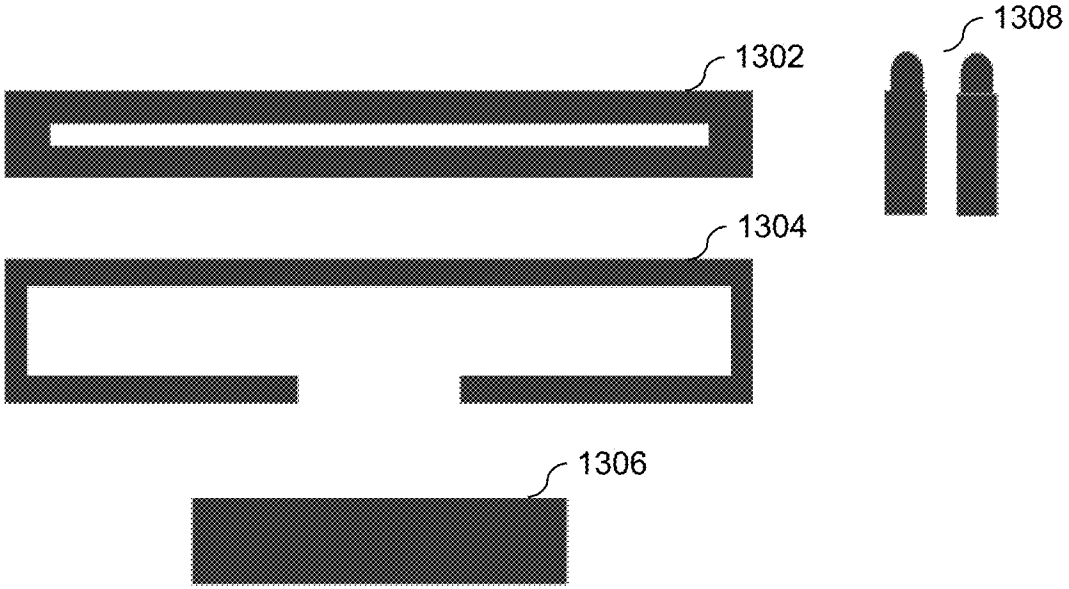
FIG. 13 illustrates architecture of a wave launcher, in accordance with an aspect of the embodiments.

FIG. 13 illustrates architecture of a wave launcher. The wave launcher comprises a slot 1302, a loop 1304, a patch 1306, and connectors 1308. The connectors 1308 may be spring loaded connectors, probes, cables, stubs, strips, micro-strips, lines, etc. More specifically, the wave launcher may be termed as a feeding device where radio frequency signal energy travels from a 'RF circuit' on a 'printed circuit board' to a surface of dielectric transparent substrate. The wave launcher may also be in a form of a PCB, metal pin, ITO on transparent substrate or any conductive material, for example, PCB slot feed, PCB/ITO loop, etc.

The wave launcher can be placed at any surface of the dielectric transparent substrate. However, in an exemplary embodiment, the wave launcher is preferably placed at the edges of the dielectric transparent substrate. Edges of the dielectric transparent substrate are preferred as it makes it easy to be used by any electronic product's structure. Also, by putting the wave launcher on the edges of the dielectric transparent substrate, the wave launcher will not block any visual contact from the device's LCD display. In another embodiment, the wave launcher can be placed behind the LCD display so that it cannot be seen through the dielectric transparent substrate and does not affect the transparency.

Figure 14:
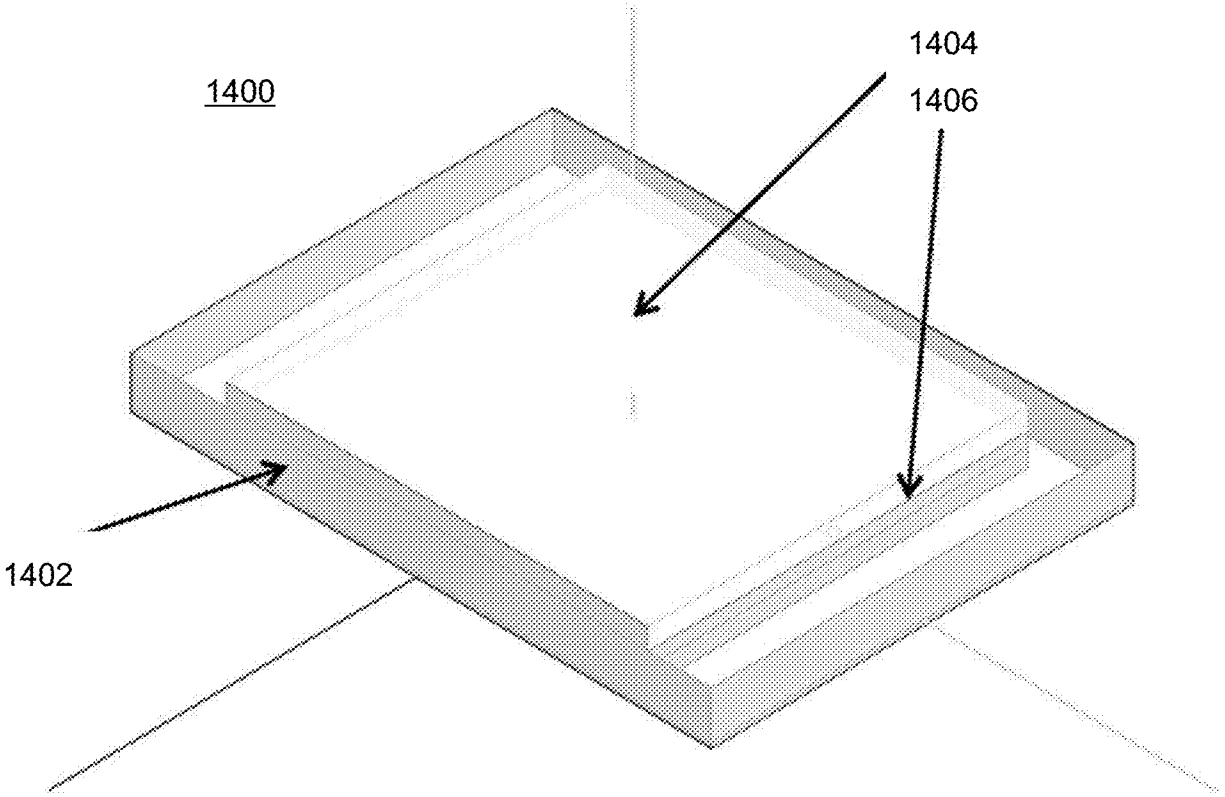
FIG. 14 illustrates architecture of a wearable wrist watch comprising a dielectric transparent substrate serving as an antenna, in accordance with an aspect of the embodiments.

FIG. 14 illustrates architecture of a wearable wrist watch comprising the dielectric transparent substrate serving as an antenna. As shown, the wrist watch 1400 comprises a base plate 1402 that holds a sapphire layer 1404 of 2 mm and a LCD layer 1406 of 1 mm. Herein, the sapphire layer works as the dielectric transparent substrate and therefore is configured to work as an antenna with the help of a wave launcher (not shown). Placement of the wave launcher is illustrated clearly in FIG. 15 of the present invention.

Figure 15:
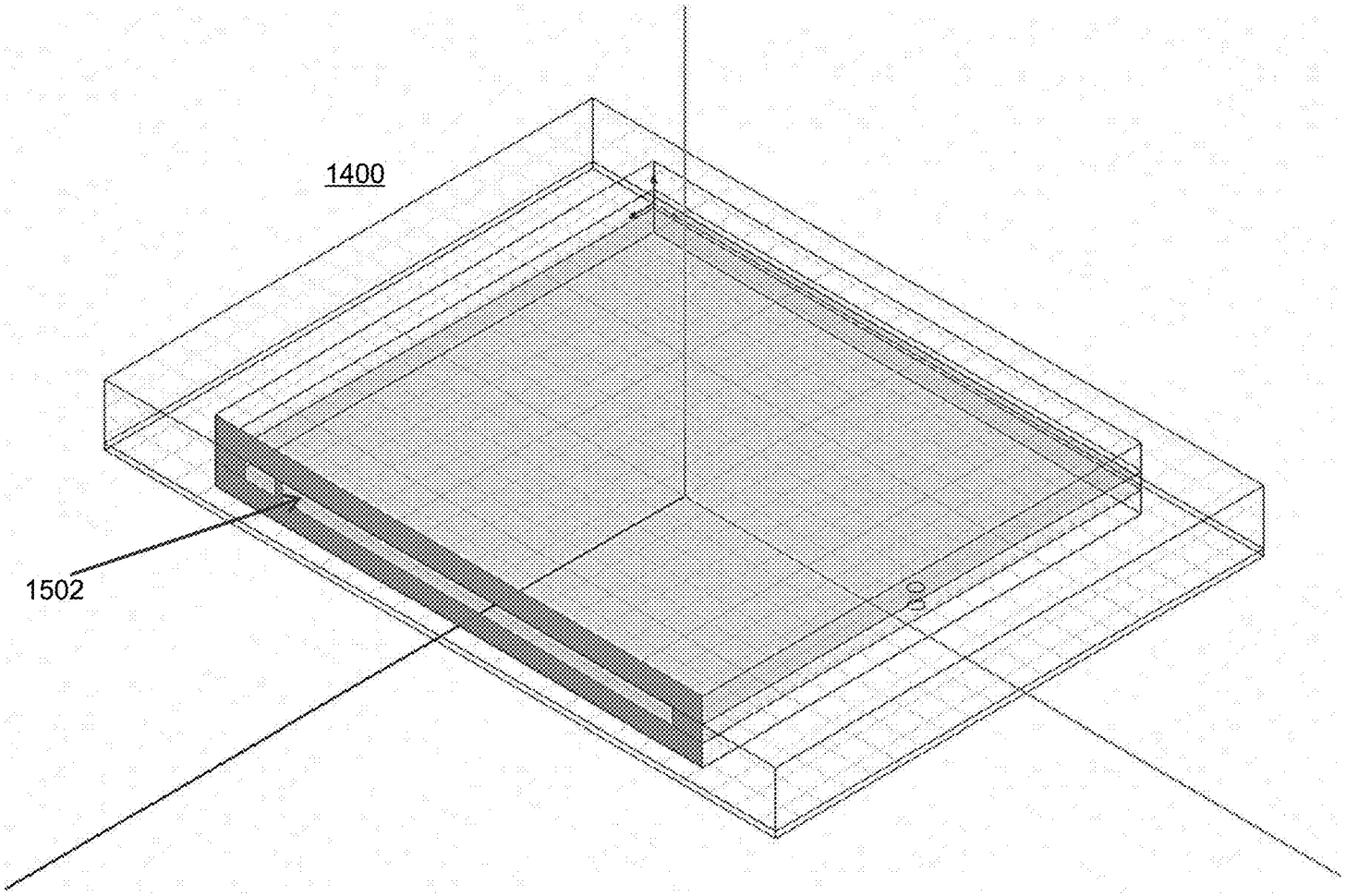
FIG. 15 illustrates another architecture of a wearable wrist watch with a representation of a wave launcher in the wrist watch, in accordance with an aspect of the embodiments.
Figure 16:
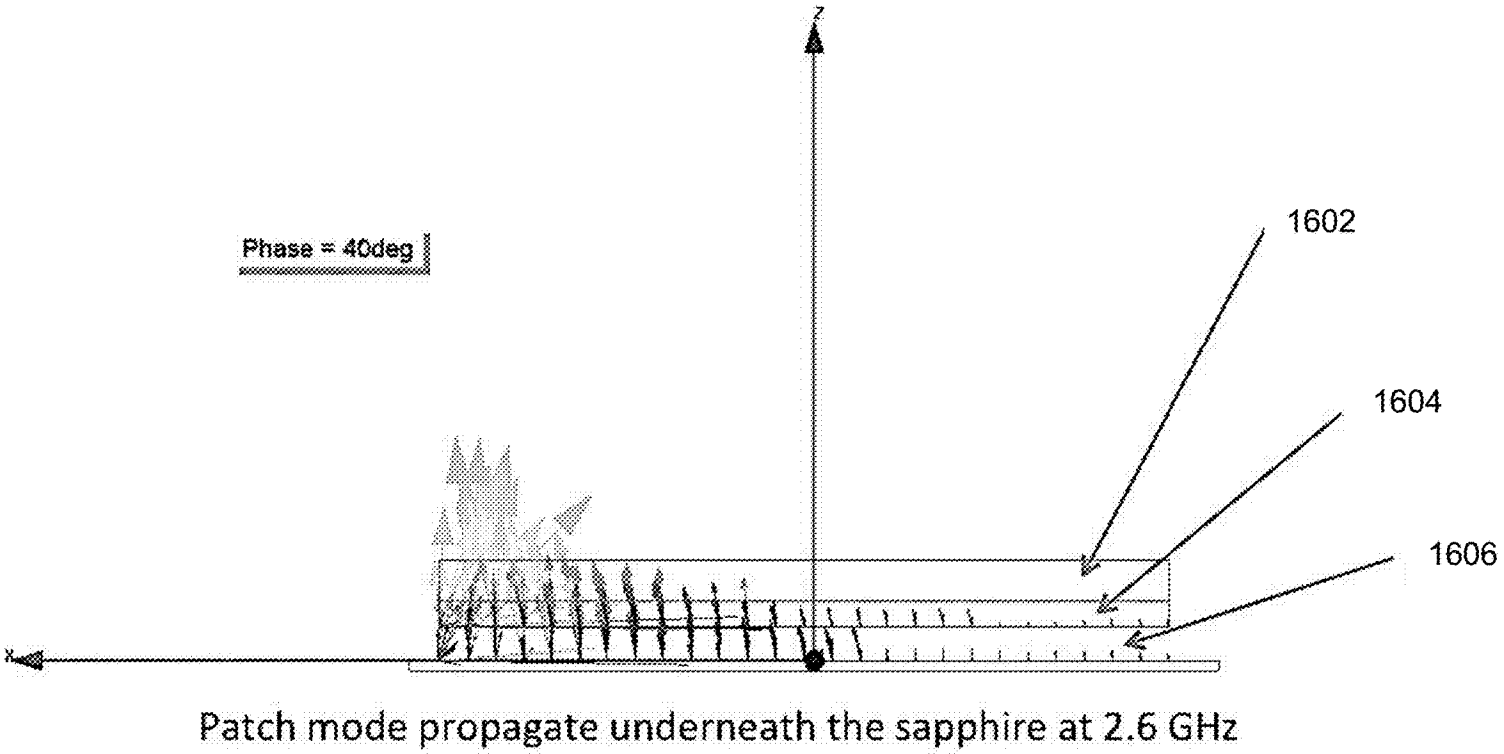
FIG. 16 illustrates simulation results of electric field produced by a sapphire layer as an antenna, in accordance with an aspect of the embodiments.

FIG. 15 illustrates another architecture of the wearable wrist watch 1400 with a representation of a wave launcher 1502 in the wrist watch 1400. The position of the wave launcher 1502 is therefore clear with the sapphire layer 1404 and the LCD layer 1406 if both the FIGS. 15 and 16 are considered together as they represent architecture of the same wrist watch 1400.

In specific, there is a connection between the wave launcher and an energy source or receiver. The wave launcher is responsible to couple energy to the dielectric transparent substrate. The electric field resonant in fundamental mode of the given structure and to produce a resonances $N*\lambda_0/4$ (N=1, 2, 3 . . . ) as a $TM_{N0}$ mode-like resonance. The energy reinforces inside the dielectric transparent substrate to create resonance $f_M$ (M=1, 2, 3 . . . ). The dielectric transparent substrate then radiates or receives electromagnetic wave with its resonance frequency $f_M$ (M=1, 2, 3 . . . ).

Furthermore, the dielectric constant $\varepsilon_r$ of dielectric transparent substrate should be larger than 2. The wave launcher can be placed at any surface of the dielectric transparent substrate. The wave launcher(s) can produce a phase different i.e. $0° \leq \Theta \leq 90°$ for the resonant frequencies $f_M$ (M=1, 2, 3 . . . ). The resonant frequencies can be from linear polarization (LP) to circular polarization (CP). The wave launcher can be placed under the LCM to couple energy to the dielectric transparent substrate so that it cannot affect the transparency of the dielectric transparent substrate.

Also, there is no limit on the shape of the dielectric transparent substrate. Moreover, multiple layers of the dielectric transparent substrate are workable. The gap between each layer of dielectric transparent substrate can be any materials such as air, liquid or solid.

FIG. 16 illustrates simulation results of electric field produced by sapphire layer 1602 when it is used as an antenna in relation to the concept of the proposed dielectric transparent substrate. As shown, the first layer 1602 is a sapphire layer that is working here as antenna and is placed just above the LCD layer 1604. Thereafter, there is a gap of height (h) filled with air, as explained earlier in conjunction with FIGS. 5 to 12 of the present invention. Herein, the path mode propagates underneath the sapphire layer 1602 at 2.6 GHz.

Figure 17B:
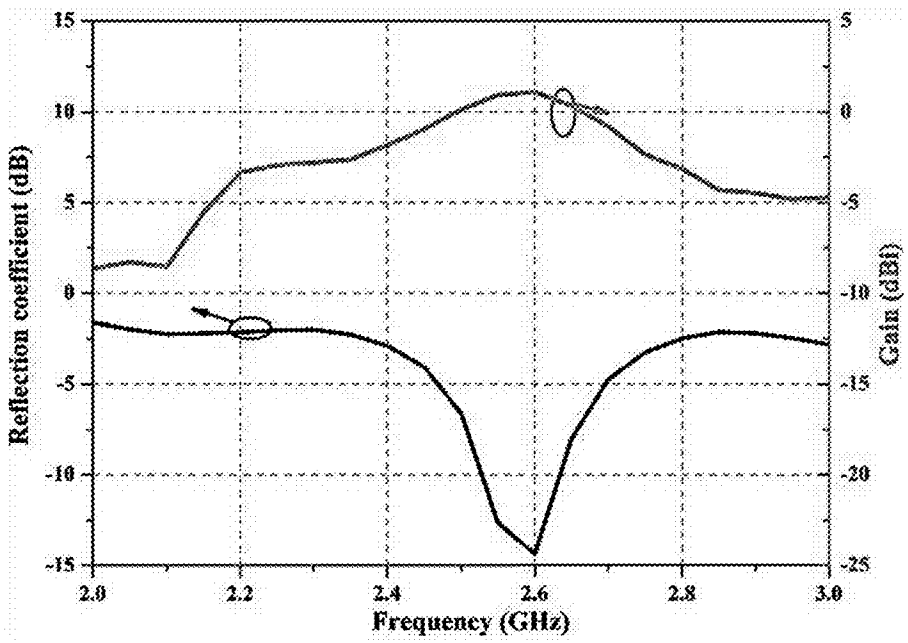
FIG. 17B illustrates measurement results in form of a graph, in accordance with an aspect of the embodiments.
Figure 17A:
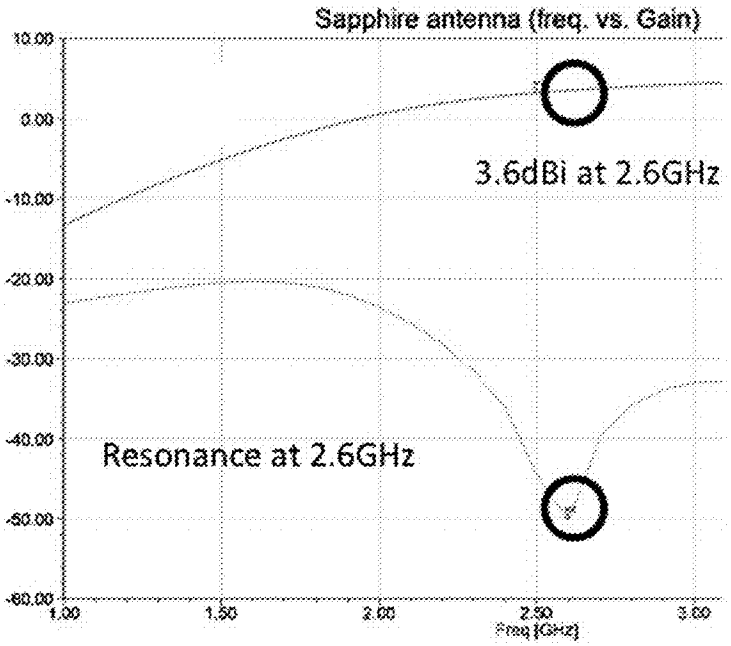
FIG. 17A illustrates simulation results in form of a graph, in accordance with an aspect of the embodiments.
Figure 18B:
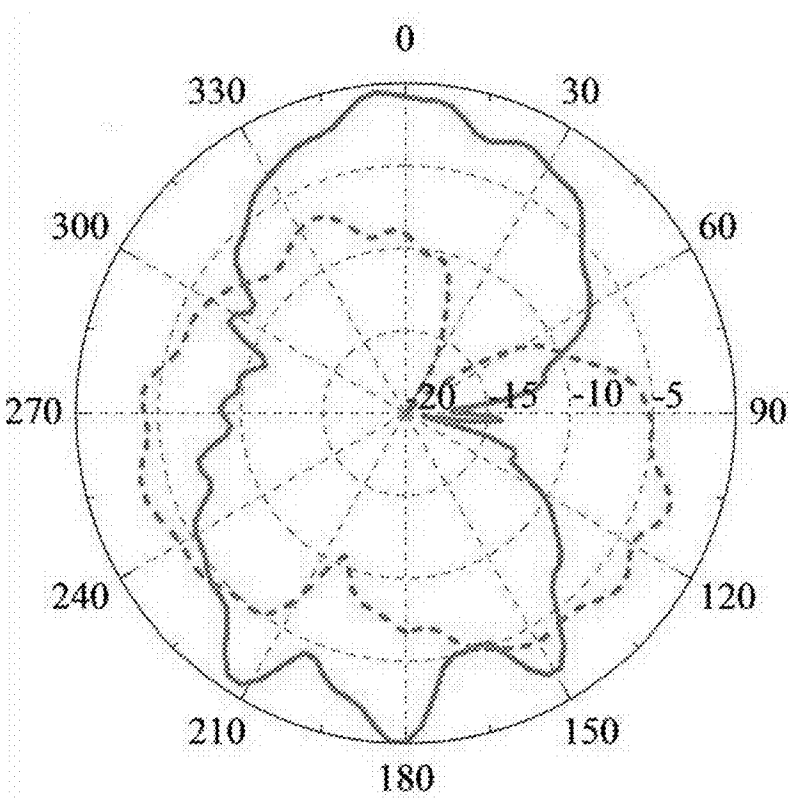
FIG. 18B illustrates measurement results of radiation patterns in form of a graph, in accordance with an aspect of the embodiments.
Figure 18A:
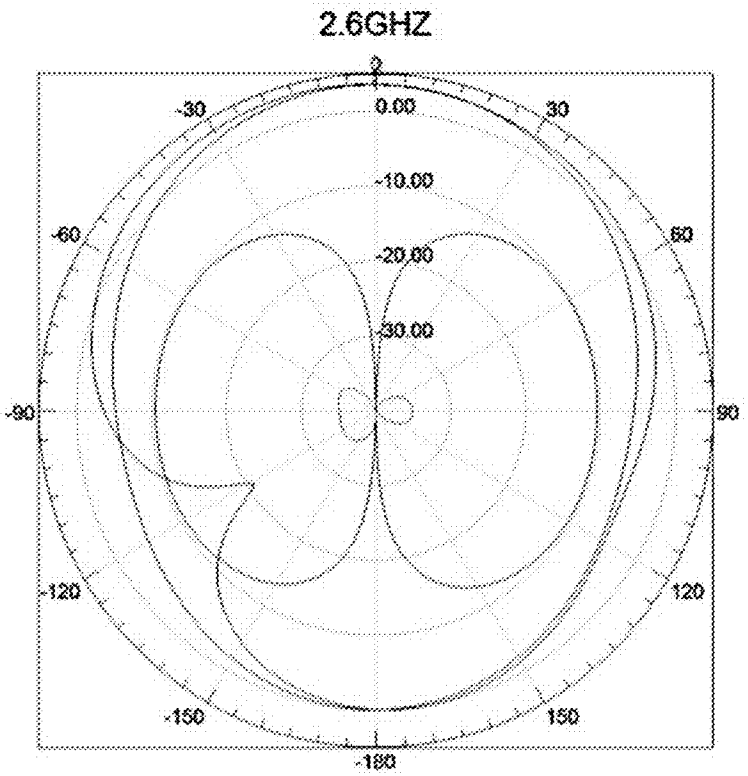
FIG. 18A illustrates simulation results of radiation patterns in form of a graph, in accordance with an aspect of the embodiments.

FIG. 17A illustrates simulation results in form of a graph. The graph illustrates simulation results of using sapphire layer as antenna. The graph further illustrates frequency vs. gain values. Similarly, FIG. 17B illustrates measurement results in form of a graph. The graph illustrates measurement results of using sapphire layer as antenna. The graph further illustrates reflection coefficient (dB) vs. frequency (GHz) vs. gain (dBi) values. As clearly evident from the graphs, resonance is found at 2.6 GHz with the nearly maximum gain both in simulation and measurement results. Similar results were obtained while comparing simulated radiation pattern as illustrated in FIG. 18A and the measured radiation pattern illustrated in FIG. 18B as they were closely matched.

Embodiments of the present disclosure discloses a dielectric transparent antenna comprising at least one layer of solid dielectric transparent substrate, at least electric circuit with a ground connection, and at least one wave launcher located between the dielectric transparent substrate and the electric circuit with a separation space (h). Herein, the space (h) is equal or greater than 1/10 wavelength of resonant frequency.

Further, in an embodiment of the present disclosure, the wave launcher couples energy to the dielectric transparent substrate. In another embodiment of the present disclosure, the energy reinforces inside the dielectric transparent substrate to create resonant frequency. In another embodiment of the present disclosure, the wave launcher enables the dielectric transparent substrate to radiate electromagnetic wave with the resonant frequency. Herein, the dielectric transparent substrate also receives electromagnetic waves. In another embodiment of the present disclosure, the resonant frequency is of linear or circular polarization. In another embodiment of the present disclosure, the dielectric constant of the dielectric transparent substrate is larger than 2.

In another embodiment of the present disclosure, the wave launcher is placed at surface of the dielectric transparent substrate, wherein the wave launcher produces a phase difference i.e. $0° \leq \Theta \leq 90°$ for the resonant frequency. In another embodiment of the present disclosure, the dielectric transparent antenna is used in an electronic device with a display panel, wherein the wave launcher is placed under the display panel without affecting transparency of the dielectric transparent substrate.

Further, dimensions of the dielectric transparent substrate are designed according to shape and size of an electronic device. In another embodiment of the present disclosure, the dielectric transparent substrate comprises a plurality of vertical layers, horizontal layers, or both and gap between the dielectric transparent substrate layers is filled with at least one of air, liquid, plasma, and solid. In another embodiment of the present disclosure, dimension of the dielectric transparent substrate, position of wave launcher, and space (h) affects the resonant frequency.

In another embodiment of the present disclosure, length of the wave launcher is dependent upon wavelength of the resonant frequency. In another embodiment of the present disclosure, the dielectric transparent substrate is one of a transparent plastic, glass, sapphire ($Al_2O_3$), and acrylic. In another embodiment of the present disclosure, the dielectric transparent substrate comprises a semi-transparent material. In another embodiment of the present disclosure, the dielectric transparent substrate is coated/injected with another material comprising at least one of a paint, color, film.

In another embodiment of the present disclosure, the dielectric transparent substrate is installed at surface of an electronic device. In another embodiment of the present disclosure, the wave launcher is connected with a cable to a circuit board. In another embodiment of the present disclosure, the wave launcher is a feeding device where radio frequency signal energy travels from radio frequency circuit to the surface of the dielectric transparent substrate. In another embodiment of the present disclosure, the wave launcher is a printed circuit board. In another embodiment of the present disclosure, the dielectric transparent substrate layer is of 2 mm.

The order in which the method is described is not intended to be construed as a limitation, and any number of the described method blocks can be combined in any order to implement the method or alternate methods. Additionally, individual blocks may be deleted from the method without departing from the spirit and scope of the subject matter described herein. Furthermore, the method can be implemented in any suitable hardware, software, firmware, or combination thereof. However, for ease of explanation, in the embodiments described below, the method may be considered to be implemented in the above described system and/or the apparatus and/or any electronic device (not shown).

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

Note that throughout the following discussion, numerous references may be made regarding servers, services, engines, modules, interfaces, portals, platforms, or other systems formed from computing devices. It should be appreciated that the use of such terms is deemed to represent one or more computing devices having at least one processor configured to or programmed to execute software instructions stored on a computer readable tangible, non-transitory medium or also referred to as a processor-readable medium. For example, a server can include one or more computers operating as a web server, database server, or other type of computer server in a manner to fulfill described roles, responsibilities, or functions. Within the context of this document, the disclosed devices or systems are also deemed to comprise computing devices having a processor and a non-transitory memory storing instructions executable by the processor that cause the device to control, manage, or otherwise manipulate the features of the devices or systems.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "generating," or "monitoring," or "displaying," or "tracking," or "identifying," "or receiving," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the present disclosure as encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A dielectric transparent antenna, comprising: at least one layer of solid dielectric transparent substrate; at least one electric circuit with a ground connection; and at least one wave launcher located at an edge of the dielectric transparent substrate on two sides and positioned in irregular manner, wherein the wave launcher is located between the dielectric transparent substrate and the electric circuit with a separation space (h), wherein the wave launcher couples energy to the dielectric transparent substrate, the wave launcher enables the dielectric transparent substrate to radiate electromagnetic wave with a $TM_{N0}$ mode-like resonant frequency; wherein the space (h) is equal or greater than 1/10 wavelength of antenna's resonant frequency and filled with air; and wherein the energy reinforces inside the dielectric transparent substrate to create the resonance frequency that is minimum to no interference in radiations in order to improve performance of the antenna as the radiation is not blocked by metals.

2. The dielectric transparent antenna of claim 1, wherein the dielectric transparent substrate receives electromagnetic waves.

3. The dielectric transparent antenna of claim 1, wherein the resonant frequency is of linear polarization or circular poloarization.

4. The dielectric transparent antenna of claim 1, wherein dielectric constant of the dielectric transparent substrate is larger than or equal to 2.

5. The dielectric transparent antenna of claim 1, wherein the wave launcher is placed at surface of the dielectric transparent substrate.

6. The dielectric transparent antenna of claim 1, wherein the wave launcher produces a phase difference i.e. $0° \leq \Theta \leq 90°$ for the resonant frequency for wave launchers positioned in irregular manner.

7. The dielectric transparent antenna of claim 1 is used in an electronic device with a display panel and a liquid crystal module (LCM).

8. The dielectric transparent antenna of claim 7, wherein the wave launcher is placed under the display panel without affecting transparency of the dielectric transparent substrate.

9. The dielectric transparent antenna of claim 1, wherein structure of wave launcher is a form of slot, a loop, a patch, or connectors.

10. The dielectric transparent antenna of claim 1, wherein the dielectric transparent substrate comprises a plurality of vertical layers, horizontal layers, or a combination thereof.

11. The dielectric transparent antenna of claim 10, wherein a gap between the dielectric transparent substrate layers is filled with at least one of air, liquid, plasma, and solid.

12. The dielectric transparent antenna of claim 1, wherein a dimension of the dielectric transparent substrate, a position of the wave launcher, or the space (h) affects the resonant frequency.

13. The dielectric transparent antenna of claim 1, wherein length of the wave launcher is dependent upon wavelength of the resonant frequency.

14. The dielectric transparent antenna of claim 1, wherein the dielectric transparent substrate is one of a transparent plastic, glass, sapphire ($Al_2O_3$), and acrylic.

15. The dielectric transparent antenna of claim 1, wherein the dielectric transparent substrate comprises a fully transparent material or a semi-transparent material.

16. The dielectric transparent antenna of claim 1, wherein the dielectric transparent substrate is coated or injected with another material comprising at least one of a paint, liquid, color, film, and protective material.

17. The dielectric transparent antenna of claim 1, wherein the wave launcher is a feeding device coupling radio frequency signal energy from a radio frequency circuit to a surface of the dielectric transparent substrate.

18. The dielectric transparent antenna of claim 1, wherein the wave launcher is placed on at least two edges of the dielectric transparent substrate for producing multiple resonance frequencies.

19. The dielectric transparent antenna of claim 7, wherein the wave launcher is placed under the LCM without affecting transparency of the dielectric transparent substrate.

* * * * *